US011220776B1

(12) United States Patent
Gordon et al.

(10) Patent No.: US 11,220,776 B1
(45) Date of Patent: Jan. 11, 2022

(54) RADIOLOGY GARMENT DISPENSING, CLEANING, AND TRACKING SYSTEM

(71) Applicants: Nikia Gordon, Massapequa, NY (US); Tashma Watson, Brooklyn, NY (US)

(72) Inventors: Nikia Gordon, Massapequa, NY (US); Tashma Watson, Brooklyn, NY (US)

( * ) Notice: Subject to any disclaimer, the term of this patent is extended or adjusted under 35 U.S.C. 154(b) by 0 days.

(21) Appl. No.: 16/919,492

(22) Filed: Jul. 2, 2020

Related U.S. Application Data

(60) Continuation-in-part of application No. 16/221,788, filed on Dec. 17, 2018, now Pat. No. 10,793,988, which is a division of application No. 15/246,022, filed on Aug. 24, 2016, now Pat. No. 10,179,965.

(60) Provisional application No. 62/212,428, filed on Aug. 31, 2015.

(51) Int. Cl.

| | |
|---|---|
| ***D06F 34/28*** | (2020.01) |
| ***G21F 3/02*** | (2006.01) |
| ***B08B 1/00*** | (2006.01) |
| ***D06F 9/00*** | (2006.01) |
| ***A47G 25/16*** | (2006.01) |
| ***A46B 13/02*** | (2006.01) |

(52) U.S. Cl.
CPC ..... *D06F 34/28* (2020.02); *A46B 13/02* (2013.01); *A47G 25/16* (2013.01); *B08B 1/002* (2013.01); *B08B 1/008* (2013.01); *D06F 9/00* (2013.01); *G21F 3/02* (2013.01)

(58) Field of Classification Search
None
See application file for complete search history.

(56) References Cited

U.S. PATENT DOCUMENTS

| | | | |
|---|---|---|---|
| 5,912,818 | A | 6/1999 | McGrady et al. |
| D424,198 | S | 5/2000 | Shepherd et al. |
| 6,330,856 | B1 | 12/2001 | Fitzgerald et al. |
| 6,845,888 | B2 | 1/2005 | Verherbrugghen et al. |
| 7,350,680 | B2 | 4/2008 | DeBroeck |
| 7,474,938 | B2 | 1/2009 | Poliner |

(Continued)

FOREIGN PATENT DOCUMENTS

| | | |
|---|---|---|
| WO | WO2004086165 | 10/2004 |

*Primary Examiner* — Cristi J Tate-Sims
(74) *Attorney, Agent, or Firm* — Goldstein Law Offices, P.C.

(57) ABSTRACT

A system for dispensing, cleaning, and tracking radiological protective garments is disclosed. The system includes a storage apparatus having upper compartments, lower compartments, a cleaning system, and an x-ray emitter and x-ray detector. The upper compartments and lower compartments receive radiological protective garments therein. The cleaning system includes a nozzle that expels disinfectant onto radiological protective garments positioned in the upper compartments or the lower compartments and a drying apparatus that dries the radiological protective garments after being disinfected. The x-ray emitter emits x-rays at a radiological protective garment positioned in the upper compartments or the lower compartments and the x-ray detector detects x-rays traversing the radiological protective garment to test the radiation shielding integrity of the radiological protective garment. The x-ray emitter and x-ray detector move about the storage apparatus from compartment to compartment to test the radiation shielding integrity of multiple radiological protective garments disposed across the compartments.

17 Claims, 8 Drawing Sheets

(56) References Cited

U.S. PATENT DOCUMENTS

| | | | | |
|---|---|---|---|---|
| 7,663,128 | B2 | 2/2010 | Arterson | |
| 8,608,022 | B1 | 12/2013 | Kory | |
| 8,763,824 | B2 | 7/2014 | Alcock | |
| 8,955,164 | B1 | 2/2015 | Ruthemeyer | |
| 2006/0191965 | A1 | 8/2006 | DeBroeck | |
| 2015/0287488 | A1* | 10/2015 | Glickman | A41D 13/04 250/516.1 |

* cited by examiner

RADIOLOGY GARMENT DISPENSING, CLEANING, AND TRACKING SYSTEM

CROSS REFERENCE TO RELATED APPLICATIONS

This application is a continuation in part of U.S. patent application Ser. No. 16/221,788, filed on Dec. 17, 2018, which is a divisional of U.S. patent application Ser. No. 15/246,022, filed on Aug. 24, 2016, which claims the benefit of priority of U.S. Patent Application Ser. No. 62/212,428, filed on Aug. 31, 2015, which are relied upon and incorporated herein by reference in their entirety. The entire disclosure of any publication or patent document mentioned herein is entirely incorporated by reference.

TECHNICAL FIELD

The present disclosure relates generally to systems for dispensing and storing garments. More particularly, the present disclosure relates to a system for dispensing, storing, cleaning, and monitoring the use of radiological protective garments.

BACKGROUND

The use of x-ray imagery is almost ubiquitous in facilities that provide healthcare services. X-ray imagery allows doctors to view the internal structures of patients without conducting invasive surgery. There are a number of techniques that use x-ray radiation in order to obtain images of a patient, such as radiography, computed tomography, and fluoroscopy. While the exact use of x-rays in generating diagnostic quality imaging differs, all of these techniques on some level bombard the patient with x-ray radiation.

While x-ray radiation can be an incredibly useful diagnostic tool, overexposure to x-ray radiation can cause serious harm or death in patients. As such, the use of radiological protective garments has become standard practice whenever a patient is subjected to x-ray radiation.

However, as x-ray imagery is being utilized in increasing amounts, the ability of healthcare facilities to maintain safe and adequate supplies of these radiological protective garments becomes a large challenge. Indeed, as these radiological protective garments are utilized more it is necessary to ensure that they prevent substantially all radiation from traversing the garment. Further, there are regulatory requirements that place restrictions on the use and cleaning of radiological protective garments in healthcare facilities, set forth by organizations such as the Centers for Medicare and Medicaid Services, the Department of Health, and the Joint Commission on Accreditation of Healthcare Organizations. While beneficial, these regulations result in additional hurdles to providing x-ray imagery to patients.

Accordingly, there is a need for a system that can clean radiological protective garments efficiently, track the usage of the radiological protective garments used by healthcare facilities, and check the radiation shielding integrity of the radiological protective garments.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a radiological protective garment system that houses radiological protective garments. Accordingly, the present disclosure provides a storage apparatus including upper compartments and lower compartments that receive radiological protective garments including radiological protective aprons, radiological protective glasses, radiological protective gloves, radiological protective sleeves, radiological protective head covers, and radiological protective thyroid shields.

An aspect of an example embodiment in the present disclosure is to provide a radiological protective garment system that effectively cleans radiological protective garments. Accordingly, the present disclosure provides a storage apparatus including a cleaning system that mists cleaning liquid onto radiological protective garments stored within the storage apparatus and dries the radiological protective garment for use.

An aspect of an example embodiment of the present disclosure is to provide a radiological protective garment system that can check the radiation shielding integrity of a radiological protective garment. Accordingly, the present disclosure provides a storage apparatus housing an x-ray emitter that emits x-rays at a radiological protective garment and an x-ray detector that detects emitted x-rays that traverse the radiological protective garment.

An aspect of an example embodiment of the present disclosure is to provide a radiological protective garment system that is capable of tracking the use of radiological protective garments in a facility inventory. Accordingly, the present disclosure provides a system including a monitoring system having an ID card and an ID card reader, in which all users are provided an ID card with a unique identifier and in which all radiological protective garments are tracked according to when users scan their ID card with the ID card reader to retrieve or replace one of the radiological protective garments.

An aspect of an example embodiment of the present disclosure is to provide a radiological protective garment system that automates the cleaning process of a radiological protective garment. Accordingly, the present disclosure provides a system that monitors when a radiological protective garment is placed therein and automatically initiates the cleaning process of the radiological protective garment for subsequent use.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
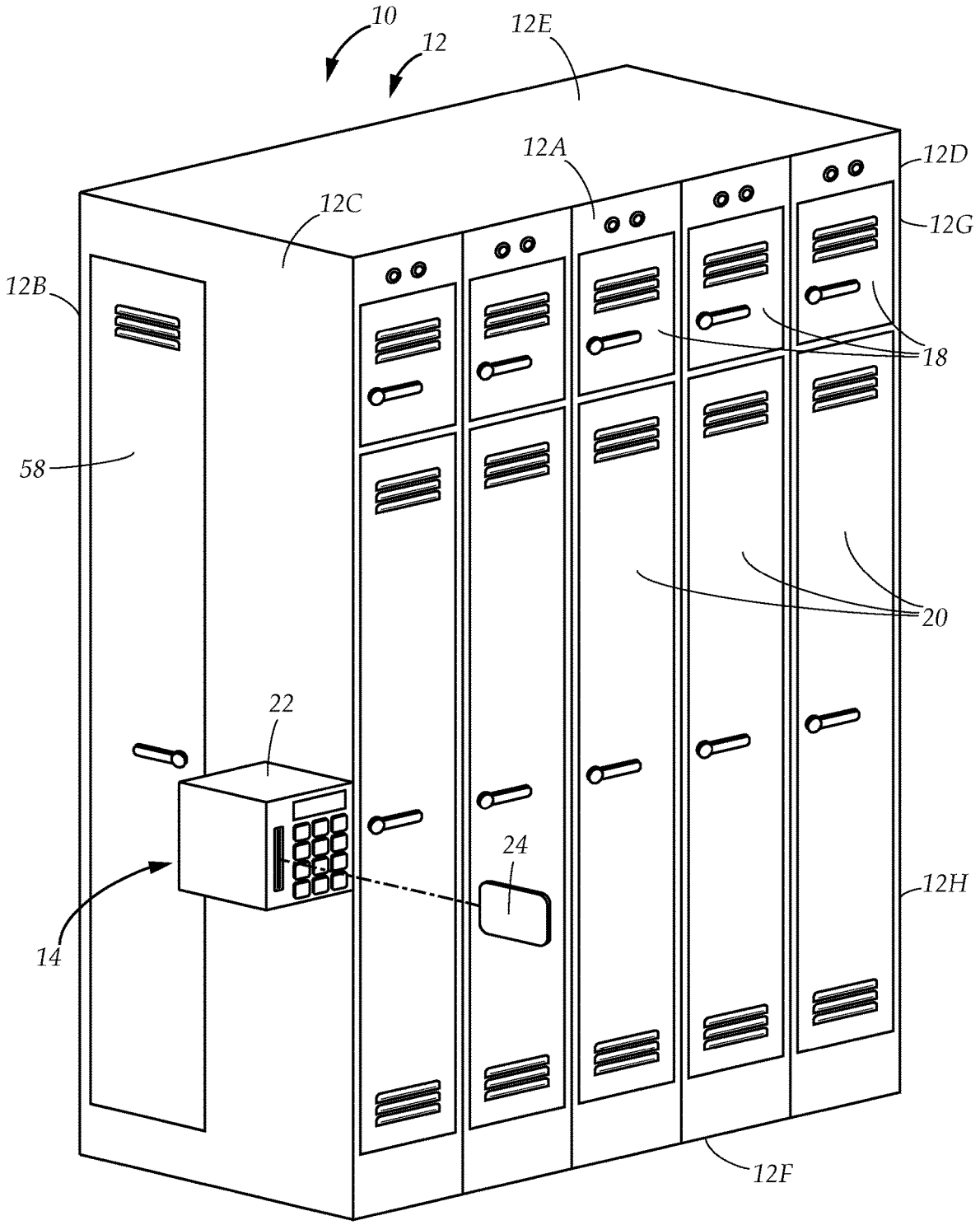
FIG. 1 is an exploded perspective view of the storage apparatus of the radiology garment dispensing, cleaning, and tracking system, illustrating the upper compartments and the lower compartments in a closed configuration prior to the insertion of an ID card into the ID card reader according to one embodiment of the present disclosure.
Figure 2:
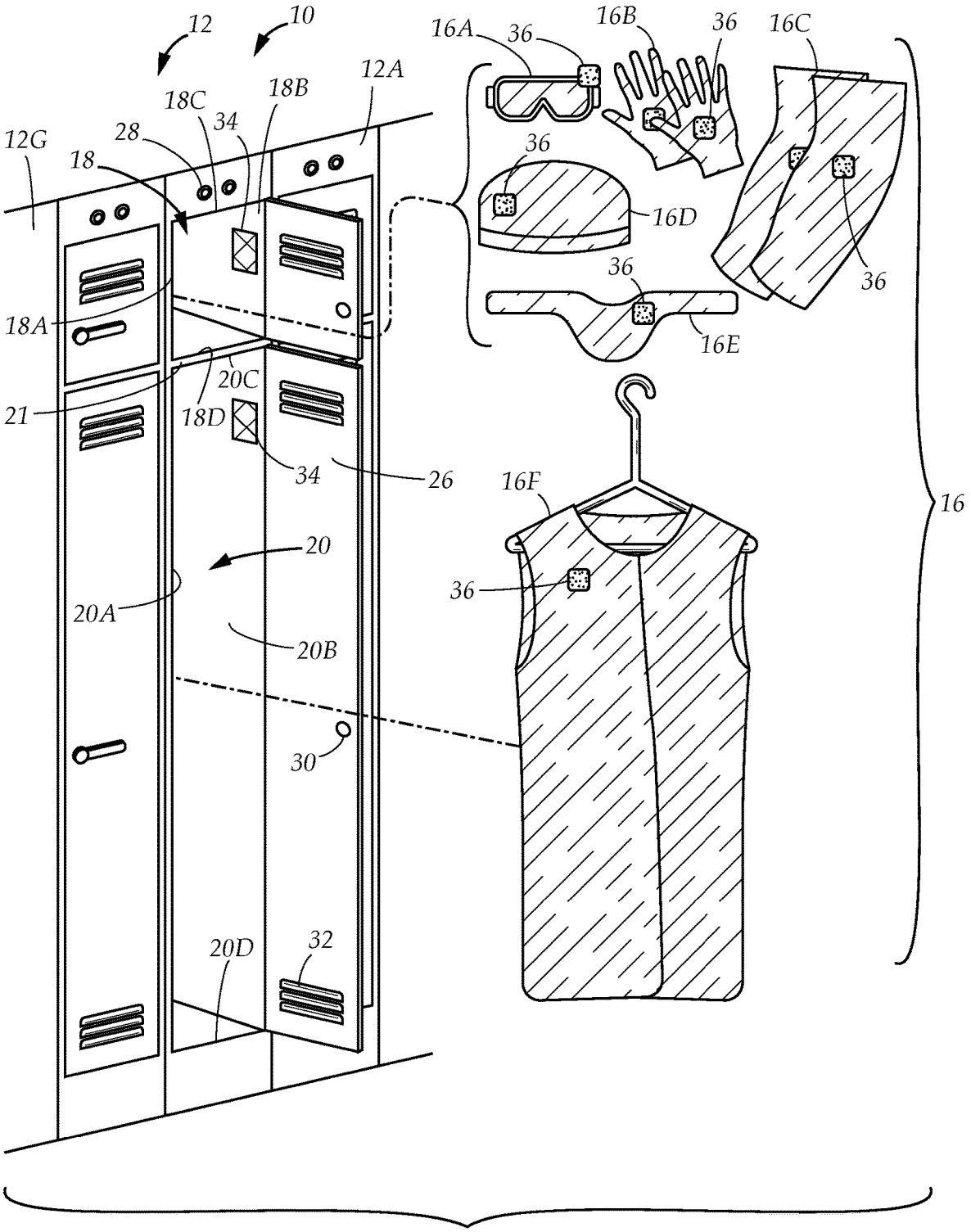
FIG. 2 is an exploded perspective close-up view of the storage apparatus of the radiology garment dispensing, cleaning, and tracking system, illustrating the upper compartments and the lower compartments in an open configuration after insertion of an ID card into the ID card reader and one manner in which the radiological protective garments fit within the upper and lower compartments according to one embodiment of the present disclosure.

FIG. 1 illustrates a radiology protective dispensing, cleaning, and tracking system 10 comprising a storage apparatus 12 and a monitoring system 14 coupled to the storage apparatus 12. The storage apparatus 12 receives and stores radiological protective garments 16 (see. FIG. 2) including radiological protective aprons, radiological protective glasses, radiological protective gloves, radiological protective sleeves, a radiological protective head cover, and a radiological protective thyroid shield. The monitoring system 14 keeps tracks of the usage of the radiological protective garments 16.

The storage apparatus 12 includes a front side 12A, a rear side 12B, the front side 12A opposite the rear side 12B, a first side 12C, a second side 12D, the first side 12C opposite the second side 12D, a top side 12E, a bottom side 12F, the top side 12E opposite the bottom side 12F, an upper end 12G, and a lower end 12H, the upper end 12G adjacent to the top side 12E, and the lower end 12H adjacent to the bottom side 12F. The storage apparatus 12 comprises a plurality of upper compartments 18 disposed in the upper end 12G and a plurality of lower compartments 20 extending longitudinally from the upper end 12G to the lower end 12H. The upper compartments 18 and the lower compartments 20 are positioned laterally across the storage apparatus 12 from the first side 12C to the second side 12D. The upper compartments 18 are disposed adjacent to the lower compartments 20 and are aligned along a longitudinal length of the storage apparatus 12. In some embodiments, the upper compartments 18 are disposed above the lower compartments 20. In other embodiments, the upper compartments 18 include the same width and depth as the lower compartments 20.

The monitoring system 14 comprises an ID card reader 22, an ID card 24 having a unique identifier corresponding to a radiological protective garment, a memory unit, and a processor. In some embodiments, the memory unit and the processor are housed within the ID card reader. In other embodiments, the memory unit and the processor are remote to the ID card reader 22 and communicate with ID card reader 22 via a computer network such as the Internet.

The monitoring system 14 is positioned adjacent to the storage apparatus 12. For example, in one embodiment, the monitoring system 14 is attached to the first side of the storage apparatus 12 for convenient access by a user. The monitoring system 14 keeps track of a particular ID card used, when particular ID cards are used, and the status of one or more radiological protective garments associated with the ID card.

Referring now to FIG. 2, each of the upper compartments 18 comprises a first side 18A, a second side 18B, the first side 18A opposite the second side 18B, an upper end 18C, and a lower end 18D, the upper end 18C opposite the lower end 18D. Each of the upper compartments 18 are configured to receive the radiological protective garments 16 including at least one of radiological protective glasses 16A, radiological protective gloves 16B, radiological protective sleeves 16C, a radiological protective head cover 16D, and a radiological protective thyroid shield 16E between the first side 18A and the second side 18B.

Each of the lower compartments 20 includes a first side 20A, a second side 20B, the first side 20A opposite the second side 20B, an upper end 20C, and a lower end 20D, the upper end 20C opposite the lower end 20D. Each of the lower compartments 20 is configured to receive at least one of the radiological protective garments 16 including a radiological protective apron 16F, the radiological protective glasses 16A, the radiological protective gloves 16B, the radiological protective sleeves 16C, the radiological protective head cover 16D, and the radiological protective thyroid shield 16E between the first side 20A and the second side 20B.

The upper compartments 18 and the lower compartments 20 are separated by a divider wall 21 disposed within the storage apparatus 12. The divider wall 21 is positioned in the upper end 12G of the storage apparatus 12 and extends from the first side 12C (see FIG. 1) of the storage apparatus 12 to the second side 12D (see FIG. 1) of the storage apparatus 12. The divider wall 21 defines the boundary between the upper compartments 18 and the lower compartments 20. The divider wall 21 can include perforations for facilitating cleaning of the radiological protective garments 16 disposed within the upper compartment 18 during the cleaning operation described hereinbelow.

The upper compartments 18 and the lowers compartments 20 each comprise a door 26, a status light 28 in communication with monitoring system, and a lock 30 for securing the upper compartments 18 and the lower compartments 20 in a closed configuration. The door 26 is disposed on the front side 12A of the storage apparatus 12 and configured to provide access to each of the upper compartments 18 and the lower compartments 20. The door 26 comprises a vent 32 to facilitate drying following the radiological protective garment cleaning process described hereinbelow. In some embodiments, the door 26 comprises lead to prevent x-ray radiation from traversing the door 26 during the radiological protective garment testing process described hereinbelow. In other embodiments, the door 26 may be made of clear leaded glass so that items stored in the upper compartments 18 and the lower compartments 20 may be viewed by a user, while still preventing x-ray radiation from traversing the door 26.

The lock 30 is coupled to the door 26 and is configured to secure the door 26 in a closed position, thereby preventing access to the upper compartments 18 and the lower compartments 20. The status light 28 is coupled to each of the upper compartments 18 and the lower compartments 20. The lock 30 and the status light 28 are in electronic communication with the monitoring system.

In embodiments, the system 10 comprises a RFID reader 34 in communication with the monitoring system 14 (see FIG. 1). The upper compartment 18 and the lower compartment 20 each comprise a RFID reader 34. The RFID reader 34 reads a RFID tag 36 disposed on one of the radiological protective garments 16 and communicates to the monitoring system 14 that a dirty radiological protective garment has been deposited into the storage apparatus 12. In one embodiment, an RFID reader 34 is disposed on the second sides 18B, 20B of the upper compartments 18 and the lower compartments 20 and adjacent to the front side 12A so that it can read the RFID tag 36 immediately upon insertion.

Figure 3:
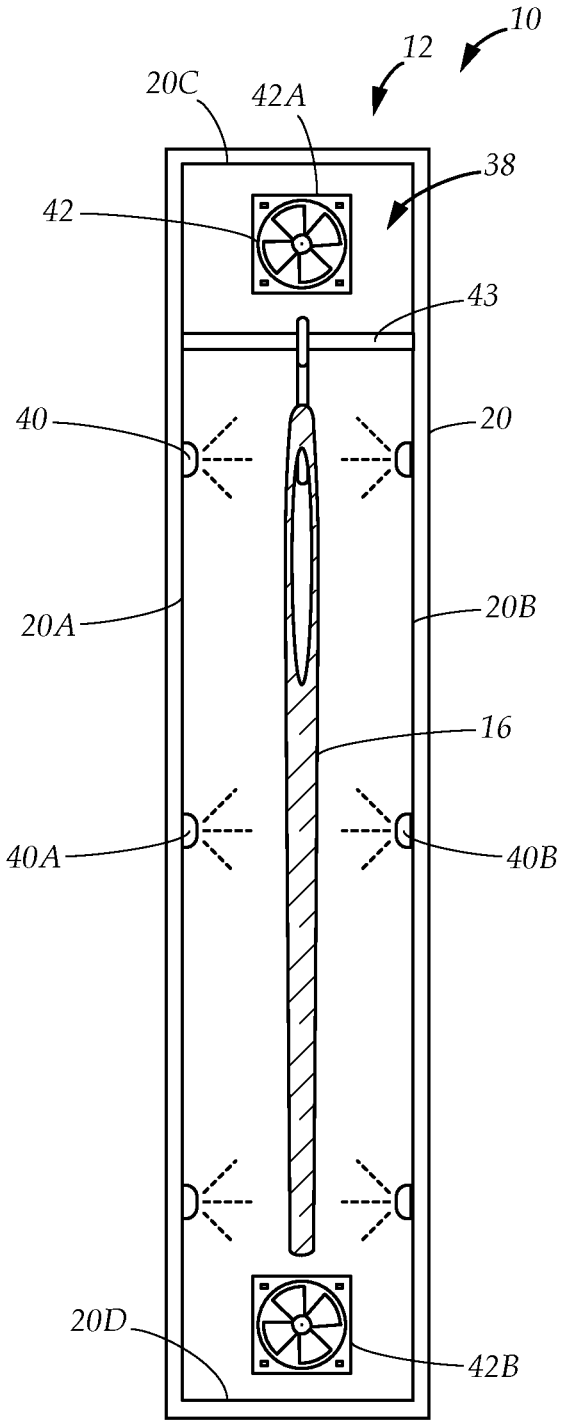
FIG. 3 is an elevation view of a lower compartment of the radiology garment dispensing, cleaning, and tracking system, illustrating the cleaning system cleaning a radiological protective garment according to one embodiment of the present disclosure.

Referring to FIG. 3, the system 10 incudes a cleaning system 38 disposed in the storage apparatus 12 that is configured to clean a radiological protective garment 16 stored in an upper compartment or lower compartment 20 of the storage apparatus 12. In embodiments, the cleaning system is disposed within the lower compartment 20. The cleaning system 38 includes a steaming/misting nozzle 40 and a drying apparatus 42. The steaming/misting nozzle 40 dispels a disinfectant onto the radiological protective garment 16 disposed inside the lower compartment 20. In some embodiments, the steaming/misting nozzle 40 steams the disinfectant onto the radiological protective garment 16. In other embodiments, the nozzle 40 mists the disinfectant onto the radiological protective garment 16.

The drying apparatus 42 dries the radiological protective garment 16 after the radiological protective garment 16 has been steamed/misted for subsequent use. In some embodiments, the cleaning system 38 comprises a steaming/misting nozzle 40A disposed on the first side 20A of one of the lower compartments 20 and a steaming/misting nozzle 40B disposed on the second side 20B of the lower compartment 20 so as to mist a first side of a radiological protective garment 16 and a second side of a radiological protective garment 16. The drying apparatus 42 comprises a dryer 42A disposed in the upper end 20C of the lower compartment 20 and a dryer 42B disposed in the lower end 20D of the lower compartment 20. The lower compartment 20 includes a rod 43 extending laterally across the upper end 20C of the lower compartment 20 from the first side 20A to the second side 20B of the lower compartment 20. The rod 43 enables a user to hang the radiological protective garment 16 in the lower compartment 20 while being cleaned and/or dried.

Figure 4A:
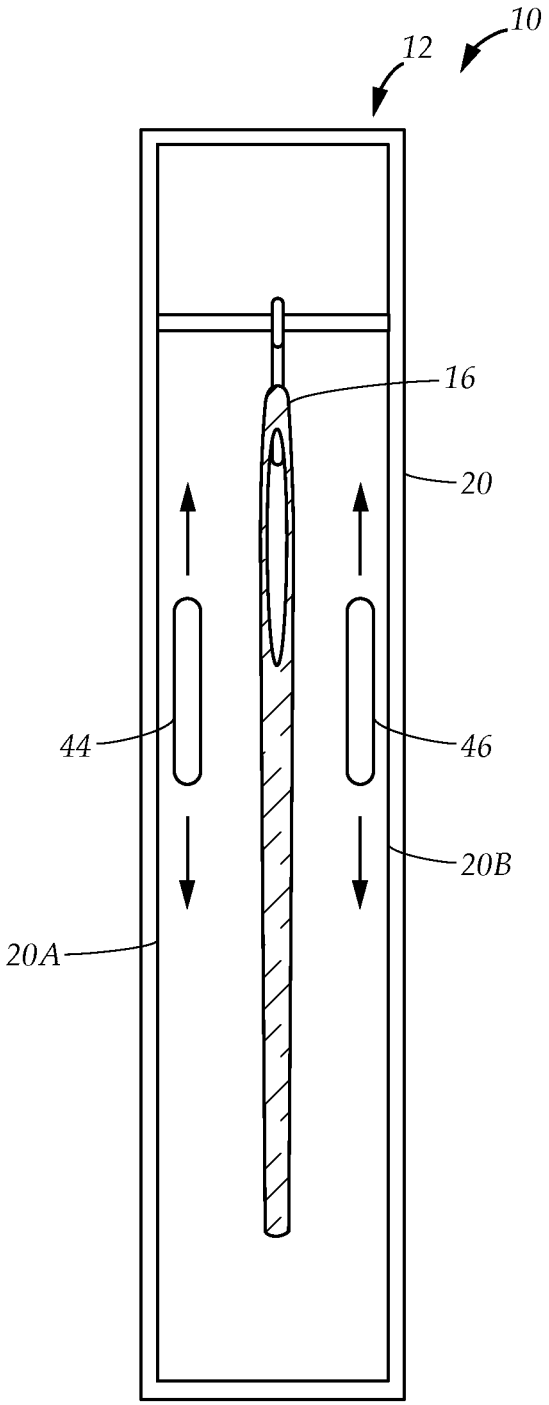
FIG. 4A is an elevation view of a lower compartment of the radiology garment dispensing, cleaning, and tracking system, illustrating the c-arm imaging scanner intensifier x-ray emitter and x-ray detector scanning a radiological protective garment according to one embodiment of the present disclosure.

Referring now to FIG. 4A, the system 10 further comprises an x-ray emitter 44 and x-ray detector 46 disposed within the storage apparatus 12 for testing the radiation shielding integrity of a radiological protective garment 16 stored within the storage apparatus 12. The x-ray emitter 44 emits x-rays at the radiological protective garment 16 and the x-ray detector 46 detects any x-rays that have traversed the radiological protective garment 16. The x-ray emitter 44 and the x-ray detector 46 are disposed in at least one of the upper compartments or at least one of the lower compartments 20.

In embodiments, the x-ray emitter 44 and the x-ray detector 46 are disposed within a lower compartment 20. The x-ray emitter 44 is disposed on the first side 20A of the lower compartment 20 so as to be positioned on a first side of the radiological protective garment 16 when the radiological protective garment 16 is positioned inside the lower compartment 20. The x-ray detector 46 is disposed on the second side 20B of the lower compartment 20 so as to be positioned on a second side of the radiological protective garment 16 when the radiological protective garment 16 is positioned inside the lower compartment 20. In this way, the x-ray emitter 44 can emits x-rays at the first side of the radiological protective garment 16 and the x-ray detector 46 can detects x-rays that have traversed the radiological protective garment 16. The x-ray emitter 44 and the x-ray detector 46 move longitudinally along the lower compartment, in tandem, to scan the radiological protective garment 16 longitudinally along the radiological protective garment 16. The x-ray emitter 44 and the x-ray detector 46 move in between the upper compartments and between the lower compartments 20 to scan a radiological protective garment 16 disposed within one of the upper compartments or within one of the lower compartments 20.

Figure 4B:
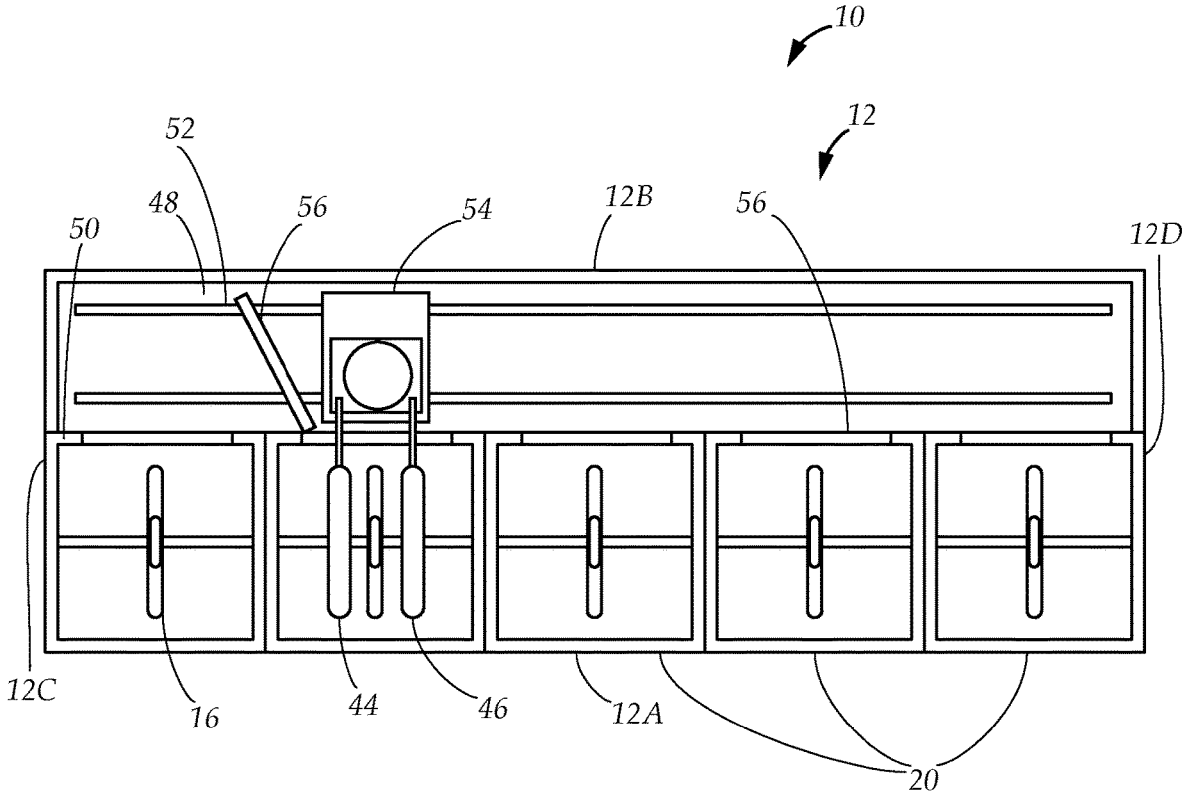
FIG. 4B is a cross-sectional top plan view of the storage apparatus of the radiology garment dispensing, cleaning, and tracking system, illustrating one manner in which the c-arm imaging scanner intensifier x-ray emitter and x-ray detector move about the storage apparatus according to one embodiment of the present disclosure.

Referring now to FIG. 4B, the system 10 comprises a chamber 48 and a partition 50 disposed within the storage apparatus 12. The chamber 48 extends longitudinally across the storage apparatus 12 from the top side to the bottom side and laterally across the storage apparatus 12 from first side 12C to the second side 12D. The chamber 48 includes a longitudinal length extending from the first side 12C to the second side 12D. The partition 50 separates the chamber 48 from the upper compartments and the lower compartments 20. The partition 50 extends laterally across the storage apparatus 12 from the first side 12C to the second side 12D and longitudinally across the storage apparatus 12 from the top side to the bottom side. The partition 50 extends parallel to the front side 12A and the rear side 12B. The chamber 48 further extends from the rear side 12B of the storage apparatus 12 to the partition 50, while the upper compartments and the lower compartments 20 extend from the partition 50 to the front side 12A of the storage apparatus 12.

The system 10 also comprises a track 52 disposed within the chamber 48 and a c-arm imaging scanner intensifier 54 disposed on the track 52. The c-arm imaging scanner intensifier 54 includes the x-ray emitter 44 and the x-ray detector 46 and travels along the track 52 between the upper compartments and between the lower compartments 20 to scan a radiological protective garment 16 disposed therein. In embodiments, the track 52 is disposed longitudinally along the longitudinal length of the chamber 48.

The system 10 further comprises a gate 56 disposed in the partition 50 at each of the upper compartments and the lower compartments 20. The gate 56 provides access to the upper compartments and the lower compartments 20 from the chamber 48, thereby coupling the chamber 48 to the upper compartments and the lower compartments 20. In this way, the c-arm imaging scanner intensifier 54 can travel from the chamber 48 through the gate 56 to an upper compartment or a lower compartment 20 to scan a radiological protective garment 16 disposed therein. In embodiments, the system 10 comprises an auxiliary door 58 (see FIG. 1) disposed on the first side 12C of the storage apparatus 12. The auxiliary door 58 provides access to the chamber 48 so a user can insert and remove the c-arm imaging scanner intensifier 54 as needed.

Figure 5:
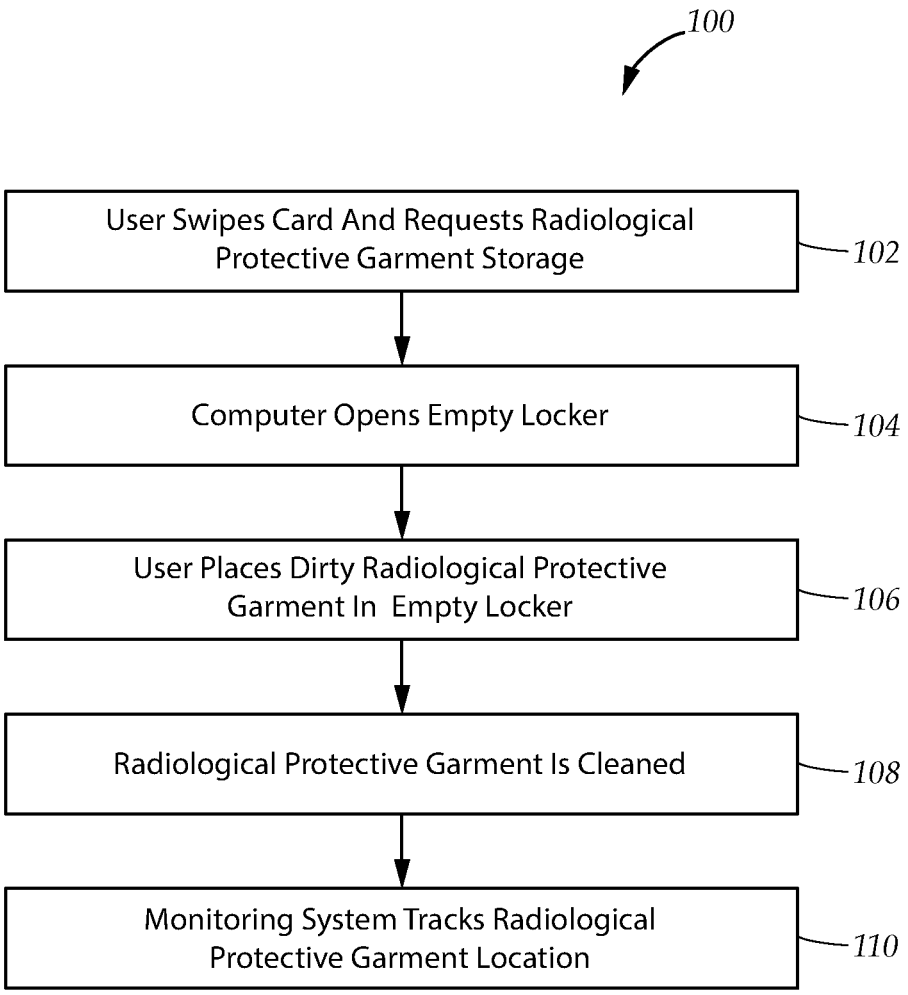
FIG. 5 is a flow chart of a method of cleaning a radiological protective garment using the radiology garment dispensing, cleaning, and tracking system according to one embodiment of the present disclosure.

FIG. 5 shows a flow chart of a method 100 of cleaning a radiological protective garment using the system of the present disclosure. In step 102, a user swipes his or her ID card through the ID card reader to request radiological protective garment storage. In step 104, the monitoring system, after receiving the user identifying information on the ID card, finds an unoccupied upper compartment or lower compartment and disengages that compartment's lock. From there, in step 106 the user places the radiological protective garment in the unlocked compartment and shuts the door. Subsequently, the monitoring system determines that the door is closed, engages the lock, and subsequently operates the cleaning system in step 108. When the system is finished cleaning the radiological protective garment, it indicates to the user that the radiological protective garment is clean by illuminating the status light. The monitoring system thereby tracks the garment location as being within the compartment in step 110.

In some embodiments, the status light includes multiple lights, each light having a unique color, and each color corresponding to a state of cleaning. For example, in one embodiment, no illuminated lights corresponds to an empty compartment, a red light corresponds to a dirty radiological protective garment being in the compartment, a yellow light corresponds to a compartment that is currently cleaning a garment, and a green light corresponds to a compartment being occupied with a cleaned garment. This is just one example of how the status light could be used to visually indicate to a user the state of a compartment's contents. The monitoring system logs the radiological protective garment as being used an additional time and will timestamp that log. The monitoring system is capable of determining the time between a radiological protective garment being cleaned and checked out. This will help a user determine the volume of a particular radiological protective garment and will help users manage their inventory of radiological protective garments.

Figure 6:
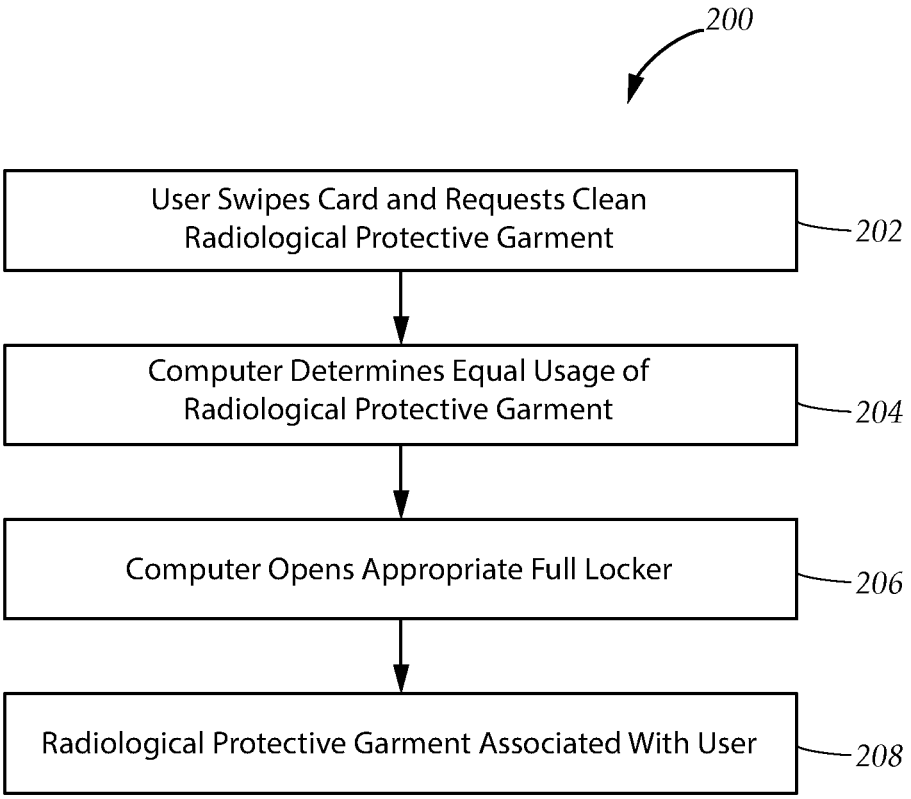
FIG. 6 is a flow chart of a method of dispensing a radiological protective garment using the radiology garment dispensing, cleaning, and tracking system according to one embodiment of the present disclosure.

FIG. 6 shows a flow chart of a method 200 of dispensing a radiological protective garment according to one embodiment of the present disclosure. When a user requires a radiological protective garment from the storage apparatus, the user first swipes their ID card to request a garment in step 202. In step 204, after the monitoring system receives the information located on the ID card, it determines the amount of use of the radiological protective garments stored in the system. This can be calculated by, for example, the amount of times the radiological protective garment has been placed into, cleaned by, and dispensed by the system. After determining which radiological protective garment has been used the least, the method proceeds to step 206 where the compartment containing the least used radiological protective garment is opened. Note that if the garment selected as having the least amount of use has been cleaned too recently—within a predetermined period of time—then the system would select a different garment and the compartment containing that radiological protective garment is opened. The user removes the radiological protective garment from the compartment and then closes that door of the compartment. The radiological protective garment is associated with the user in step 208, so that when that user again swipes his or her ID card to open one of the empty compartments, the radiological protective garment will be presumed to then be the radiological protective garment within said compartment.

Figure 7:
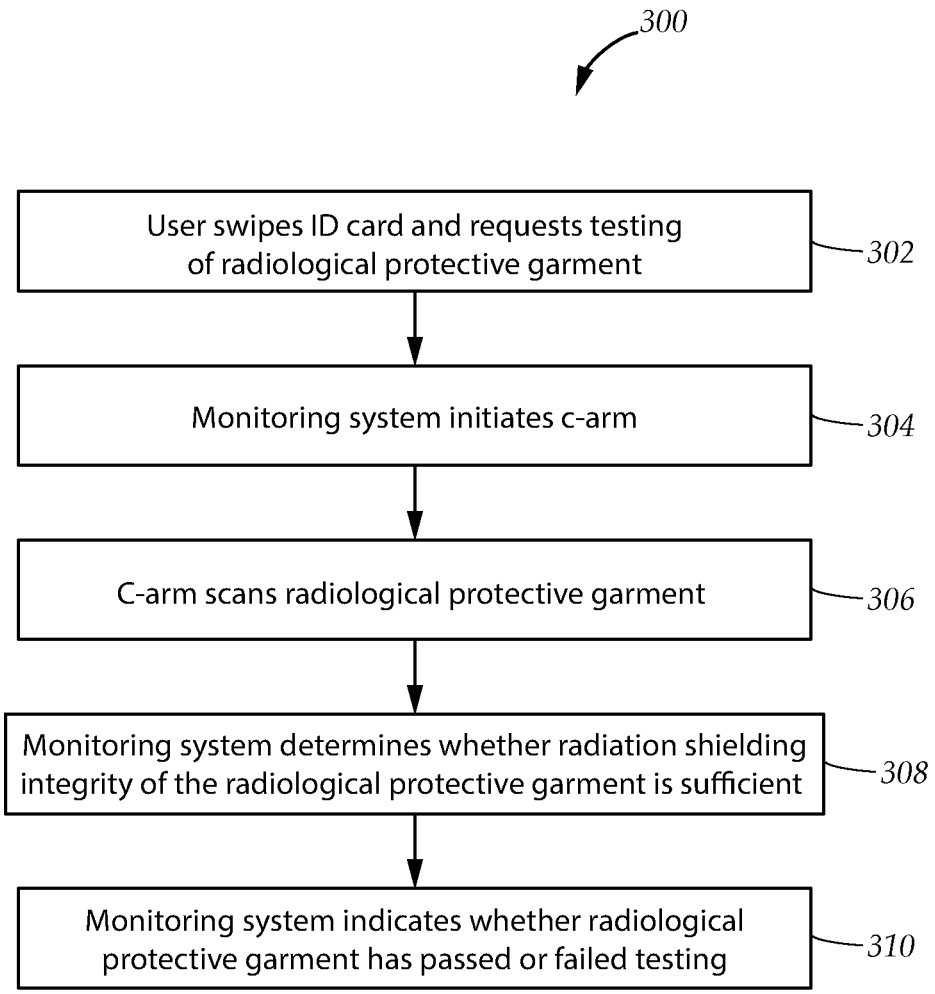
FIG. 7 is a flow chart of a method of testing the integrity of a radiological protective garment using the radiology garment dispensing, cleaning, and tracking system according to one embodiment of the present disclosure.

FIG. 7 shows a flow chart of a method 300 of testing the integrity of a radiological protective garment according to one embodiment of the present disclosure. In step 302, a user swipes their ID card through the ID card reader to request testing of a radiological protective garment. In step 304, the monitoring system, after receiving the user identifying information on the ID card, initiates the c-arm imaging scanner intensifier. From there, in step 306, a user or the system operates the c-arm imaging scanner to scan a radiological protective garment by emitting x-rays at the radiological protective garment and detecting x-rays that traverse the radiological protective garment. Subsequently, after the radiological protective garment is scanned, the monitoring system determines whether the radiation shielding integrity of the radiological protective garment is sufficient by determining the extent of radiation that traversed the radiological protective garment in step 308. In step 310, if the monitoring system determines that the radiation shielding integrity of the radiological protective garment is sufficient, then the monitoring system indicates via a status light that the radiological protective garment has passed. If the monitoring system determines that the radiation shielding integrity of the radiological protective garment is not sufficient, then the monitoring system indicates via a status light that the radiological protective garment has failed.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a radiology garment dispensing, cleaning, and tracking system. The disclosure is illustrated by example in the drawing figures, and throughout the written description. It should be understood that numerous variations are possible, while adhering to the inventive concept. Such variations are contemplated as being a part of the present disclosure.

The invention claimed is:

1. A system for dispensing, cleaning, and tracking radiological protective garments including at least a radiological protective apron and at least one of radiological protective glasses, radiological protective gloves, radiological protective sleeves, a radiological protective head cover, and a radiological protective thyroid shield, comprising:

a storage apparatus having a front side, a rear side, a first side extending from the front side to the rear side, a second side extending from the front side to the rear side, a top side, a bottom side, an upper end, a lower end, the top side and the bottom side each connected to the front side, the rear side, the first side, and the second side, a first end, and a second end, the first end disposed adjacent to the top side and the second end disposed adjacent to the bottom side;

a plurality of upper compartments disposed within the upper end, the upper compartments distributed laterally across the storage apparatus from the first side to the second side, each of the upper compartments including a first side, a second side, the first side opposite the second side, an upper end, and a lower end, the upper end opposite the lower end, each of the upper compartments configured to receive at least one of the radiological protective glasses, radiological protective gloves, radiological protective sleeves, a radiological protective head cover, and a radiological protective thyroid shield between the first side and the second side;

a plurality of elongated lower compartments extending longitudinally from the upper end to the lower end, the lower compartments distributed laterally across the storage apparatus from the first side to the second side, each of the lower compartments including a first side, a second side, the first side opposite the second side, an upper end, and a lower end, the upper end opposite the lower end, each of the lower compartments configured to receive at least one of the radiological protective garments between the first side and the second side; and a cleaning system disposed in the upper compartments and the lower compartments, the cleaning system including a nozzle and a drying apparatus, the nozzle configured to expel a disinfectant onto the radiological protective garments received by the upper compartment and the lower compartments and the drying apparatus configured to dry the radiological protective garments received by the upper compartments and the lower compartments after being cleaned with the disinfectant.

2. The system of claim 1, further comprising an x-ray emitter and x-ray detector coupled to the storage apparatus, the x-ray emitter configured to emit x-rays at a radiological protective garment and the x-ray detector configured to detect x-rays traversing the radiological protective garment.

3. The system of claim 2, wherein the x-ray emitter and the x-ray detector are disposed in at least one of the lower compartments or at least one of the upper compartments, the x-ray emitter positioned on the first side of a radiological protective garment when the radiological protective garment is positioned inside the at least one of the lower compartments or the at least one of the upper compartments, the x-ray detector positioned on a second side of the radiological protective garment when the radiological protective garment is positioned inside the at least one of the lower compartments or the at least one of the upper compartments, wherein the x-ray emitter emits x-rays at the first side of the radiological protective garment and the x-ray detector detects x-rays that have traversed the radiological protective garment.

4. The system of claim 3, wherein the x-ray detector and x-ray emitter move in between the upper compartments and the lower compartments to scan a radiological protective garment disposed within one of the upper compartments or the lower compartments.

5. The system of claim 4, further comprising:

a track disposed within the storage apparatus; and a c-arm imaging scanner intensifier disposed on the track, the c-arm imaging scanner intensifier including the x-ray emitter and the x-ray detector;

wherein the c-arm imaging scanning intensifier travels along the track in between the upper compartments and the lower compartments to scan a radiological protective garment disposed within one of the upper compartments or the lower compartments.

6. The system of claim 5, further comprising:

a chamber disposed within the storage apparatus, the chamber extending longitudinally across the storage apparatus from the top side to the bottom side and laterally across the storage apparatus from first side to the second side, the chamber including a longitudinal length extending from the first side to the second side;

a partition disposed within the storage apparatus, the partition separating the chamber from the upper compartments and the lower compartments, the partition extending laterally across the storage apparatus from the first side to the second side and longitudinally across the storage apparatus from the top side to the bottom side;

wherein the chamber extends from the rear side of the storage apparatus to the partition and the upper compartments and the lower compartments extend from the partition to the front side of the storage apparatus.

7. The system of claim 6, wherein the track is disposed longitudinally along the longitudinal length of the chamber.

8. The system of claim 7, further comprising a gate disposed in the partition at each of the upper compartments and the lower compartments, the gate providing access to the upper compartments and the lower compartments from the chamber, thereby coupling the chamber to the upper compartments and the lower compartments, wherein the c-arm imaging scanner intensifier travels from the chamber through the gate to an upper compartment or lower compartment to scan a radiological protective garment disposed therein.

9. The system of claim 8, wherein the c-arm imaging scanner intensifier moves longitudinally along the lower compartment to scan a radiological protective garment along a length of the radiological protective garment.

10. The system of claim 9, further comprising an auxiliary door disposed on the first side of the storage apparatus, the auxiliary door providing access to the chamber.

11. The system of claim 10, wherein the cleaning system comprises a misting nozzle disposed on the first side of one of the upper compartments and the lower compartments and a misting nozzle disposed on the second side of one of the upper compartments and the lower compartments so as to mist a first side of a radiological protective garment and a second side of a radiological protective garment.

12. The system of claim 11, wherein the cleaning system comprises a dryer disposed in the upper end of one of the upper compartments and the lower compartments and a dryer disposed in the lower end of one of the upper compartments and the lower compartments.

13. The system of claim 12, further comprising:

a door coupled to each of the upper compartments and the lower compartments, the door disposed on the front side of the storage apparatus and configured to provide access to each of the upper compartments and the lower compartments;

a lock coupled to the door, the lock configured to secure the door in a closed position, thereby preventing access to the upper compartments and the lower compartments; and a status light coupled to each of the upper compartments and the lower compartments.

14. The system of claim 13, further comprising:

an ID card including a unique identifier;

an ID card reader disposed on the storage apparatus; and a monitoring system, having a memory, and a processor; wherein:

the ID card reads the ID card and identifies the unique identifier of the ID card;

the monitoring system in communication with the ID card reader, the cleaning system, and the c-arm imaging scanner intensifier, the doors, and the status lights, and wherein the monitoring system is configured to monitor when a radiological protective garment is placed in the upper compartments and the lower compartments, monitor the last time the cleaning system was used, operate the cleaning system, and operate the c-arm imaging scanner intensifier.

15. The system of claim 14, wherein the monitoring system causes the status light to turn a first color when an upper compartment or a lower compartment is empty, a second color when there is a dirty radiological protective garment inside of an upper compartment or a lower compartment, a third color when a dirty radiological protective garment is being cleaned with the cleaning system, and a fourth color when an upper compartment or a lower compartment have a clean radiological protective garment.

16. The system of claim 14, further comprising a plurality of radiological protective garments including at least a radiological protective apron and at least one of radiological protective glasses, radiological protective gloves, radiological protective sleeves, a radiological protective head cover, and a radiological protective thyroid shield, each of the radiological protective garments including a unique identifier.

17. The system of claim 16, wherein each of the lower compartments comprises a unique identifier reader configured to read the unique identifier on one of the radiological protective garments.

* * * * *